US010319214B1

(12) United States Patent
Hannigan et al.

(10) Patent No.: US 10,319,214 B1
(45) Date of Patent: Jun. 11, 2019

(54) PRIORITIZING ALERT RECIPIENTS USING ACTIVITY MONITORING DATA

(71) Applicant: INTERNATIONAL BUSINESS MACHINES CORPORATION, Armonk, NY (US)

(72) Inventors: Ciaran E. Hannigan, Morrisville, NC (US); Nicholas R. Sandonato, Raleigh, NC (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/868,375

(22) Filed: Jan. 11, 2018

(51) Int. Cl.
*G08B 25/00* (2006.01)

(52) U.S. Cl.
CPC ..... *G08B 25/005* (2013.01)

(58) Field of Classification Search
CPC ..... G08B 25/005
See application file for complete search history.

(56) References Cited

U.S. PATENT DOCUMENTS 6,756,913 B1 * 6/2004 Ayed ..... G06Q 10/02 235/384
7,129,818 B1 10/2006 Begole et al.
9,767,677 B1 * 9/2017 Paulin ..... G08B 25/016
2004/0003042 A1 1/2004 Horvitz et al.
2004/0227629 A1 * 11/2004 Adamczyk ..... G08B 25/005 340/539.18
2005/0058094 A1 3/2005 Lazaridis et al.
2005/0151642 A1 * 7/2005 Tupler ..... G08B 25/08 340/539.18
2006/0177030 A1 * 8/2006 Rajagopalan ..... H04M 3/42263 379/142.07
2010/0131598 A1 * 5/2010 Ruelas-Arana ..... G06Q 10/06 709/206
2012/0218102 A1 * 8/2012 Bivens ..... G08B 25/003 340/539.13
2014/0152453 A1 * 6/2014 Dahl ..... G08B 25/005 340/686.6

(Continued)

OTHER PUBLICATIONS

Mercola, "Study: Interrupted Sleep May Be as Harmful as No Sleep at All", http://articles.mercola.com/sites/articles/archive/2014/07/24/interrupted-sleep.aspx, Mercola, Jul. 24, 2014, 9 pages.

(Continued)

*Primary Examiner* — Leon Flores
(74) *Attorney, Agent, or Firm* — Jay Wahlquist; Andrew D. Wright; Roberts Mlotkowski Safran Cole & Calderon, P.C.

(57) ABSTRACT

Devices and methods for prioritizing alert recipients using activity monitoring data are disclosed. A method includes: receiving, by a computing device, an incoming alert; receiving, by the computing device, activity data corresponding to a first on-call person; determining, by the computing device, whether or not the first on-call person is available using the activity data corresponding to the first on-call person; in response to determining that the first on-call person is available, the computing device sending the incoming alert to the first on-call person; and in response to determining that the first on-call person is not available, the computing device sending the incoming alert to a second on-call person.

20 Claims, 5 Drawing Sheets

(56) References Cited

U.S. PATENT DOCUMENTS

| | | | | |
|---|---|---|---|---|
| 2014/0171146 | A1* | 6/2014 | Ma | H04M 1/72569 455/550.1 |
| 2018/0025617 | A1* | 1/2018 | Hesford | G08B 25/001 |

OTHER PUBLICATIONS

Anonymous, "Google Awareness API", https://developers.google.com/awareness/, Google Developers, accessed Nov. 27, 2017, 2 pages.

Anonymous, "Wake up to the light you need and the music you love", https://web.archive.org/web/20170601065645/http://www.withings.com/us/en/products/aura#/, Withings, accessed Jan. 10, 2018, 8 pages.

Anonymous, "Full-Stack Visibility and Actionable Insights for Better Software and Better Customer Experiences", https://www.pagerduty.com/, PagerDuty, accessed Jan. 10, 2018, 5 pages.

Anonymous, "OnPage Incident Management System", https://www.onpage.com/, OnPage, accessed Jan. 10, 2018, 5 pages.

Specification "Prioritizing Alert Recipients Using Activity Monitoring Data" and Drawings in U.S. Appl. No. 16/395,917, filed Apr. 26, 2019, 37 pages.

List of IBM Patents or Patent Applications Treated as Related, Apr. 26, 2019, 1 page.

* cited by examiner

PRIORITIZING ALERT RECIPIENTS USING ACTIVITY MONITORING DATA

BACKGROUND

The present invention generally relates to computing devices and, more particularly, to a system and method for prioritizing alert recipients using activity monitoring data.

"On-call" persons may be responsible for responding to alerts regarding various urgent situations. Software developers, information technology department personnel, medical professionals, and persons in many other fields may be on-call both during and outside of their usual working hours. For example, product developers may have "pager duty" and be on-call all day, every day. If a problem (e.g., a "bug") arises with the product at any time, an alert may be sent to the product developers that advises them of the issue. The product developers may be responsible for addressing the issue to which the alert relates. The issue may be an urgent issue that needs to be addressed immediately, even outside of usual working hours.

Multiple persons on a team may be on-call at the same time. An alert regarding an issue may be sent to every person on the team who is on-call. At any particular time, some persons may be able to address the issue to which the alert relates more quickly or with less inconvenience than other persons. For example, if three people are on-call, a first on-call person may be exercising, a second on-call person may be sleeping, and a third on-call person may be at the theatre. In this example, the first on-call person who is exercising may be able to address the issue more quickly than the second on-call person who is sleeping and the third on-call person who is at the theatre. For example, the second on-call person who is sleeping may require ten minutes to awaken and get dressed before being able to address the issue. The third on-call person who is at the theatre may require five minutes to exit the theatre before being able to address the issue. Additionally, the second on-call person and the third on-call person may be significantly inconvenienced by the alert based upon their activities at the time of the alert.

SUMMARY

In a first aspect of the invention, there is a method that includes: receiving, by a computing device, an incoming alert; receiving, by the computing device, activity data corresponding to a first on-call person; determining, by the computing device, whether or not the first on-call person is available using the activity data corresponding to the first on-call person; in response to determining that the first on-call person is available, the computing device sending the incoming alert to the first on-call person; and in response to determining that the first on-call person is not available, the computing device sending the incoming alert to a second on-call person.

In another aspect of the invention, there is a computer program product that includes a computer readable storage medium having program instructions embodied therewith. The program instructions are executable by a computing device to cause the computing device to: receive a request to transmit an alert; receive activity data corresponding to each of a plurality of on-call persons; determine, using the received activity data, each of the plurality of on-call persons is one of available and unavailable; and send the incoming alert to one of: an only available one of the plurality of on-call persons; one of a plurality of available ones of the plurality of on-call persons; or a least unavailable one of the plurality of on-call persons.

In another aspect of the invention, there is a system that includes: a hardware processor, a computer readable memory, and a computer readable storage medium associated with a computer device; program instructions of an incoming alert receiver configured to receive an alert; program instructions of an on-call person determiner configured to determine a plurality of on-call persons; program instructions of an activity data gatherer configured to receive activity data corresponding to each of the plurality of on-call persons determined by the on-call person determiner; and program instructions of an alert recipient selector configured to select an alert recipient from the plurality of on-call persons determined by the on-call person determiner using the activity data received by the activity data gatherer and to send the alert received by the incoming alert receiver to the selected alert recipient.

BRIEF DESCRIPTION OF THE DRAWINGS

The present invention is described in the detailed description which follows, in reference to the noted plurality of drawings by way of non-limiting examples of exemplary embodiments of the present invention.

DETAILED DESCRIPTION

Figure 1:
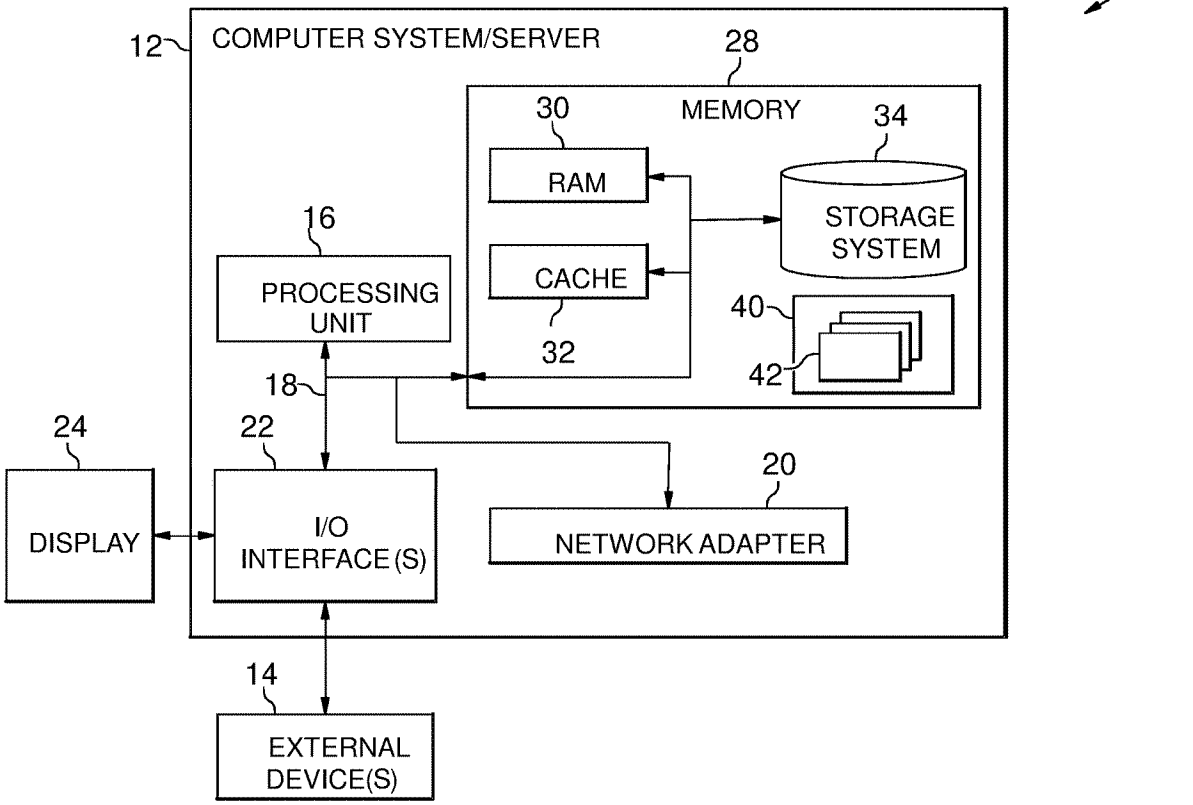
FIG. 1 depicts a computer system in accordance with aspects of the invention.

The present invention generally relates to computing devices and, more particularly, to a system and method for prioritizing alert recipients using activity monitoring data. Sending an alert regarding an issue to every person on a team who is on-call may be inefficient or ineffective as the alert may be received by one or more on-call persons who are unavailable at the time the alert is sent or who cannot address the issue immediately. Additionally, receipt of the alert may significantly inconvenience one or more on-call persons as a result of current activities of the persons. The alert may be addressable by a single person, and therefore sending the alert to every on-call person may be unnecessary.

Aspects of the invention are directed to determining a person to whom an alert is to be sent using activity monitoring data for the person. As described herein, aspects of the invention may include determining an availability status of a person using activity monitoring data and sending an alert to the person only if the person is determined to be available based on the activity monitoring data. Other aspects of the invention may include using activity monitoring data for multiple persons to determine the person who is best able to address an alert and causing the alert to be sent to that person.

The present invention may be a system, a method, and/or a computer program product at any possible technical detail level of integration. The computer program product may include a computer readable storage medium (or media)

having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a wave-guide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Referring now to FIG. 1, a schematic of an example of a computing infrastructure is shown. Computing infrastructure 10 is only one example of a suitable computing infrastructure and is not intended to suggest any limitation as to the scope of use or functionality of embodiments of the invention described herein. Regardless, computing infrastructure 10 is capable of being implemented and/or performing any of the functionality set forth hereinabove.

In computing infrastructure 10 there is a computer system (or server) 12, which is operational with numerous other general purpose or special purpose computing system environments or configurations. Examples of well-known computing systems, environments, and/or configurations that may be suitable for use with computer system 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system 12 may be described in the general context of computer system executable instructions, such as program modules, being executed by a computer system. Generally, program modules may include routines, programs, objects, components, logic, data structures, and so on that perform particular tasks or implement particular abstract data types. Computer system 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system 12 in computing infrastructure 10 is shown in the form of a general-purpose computing device. The components of computer system 12 may include, but are not limited to, one or more processors or processing units (e.g., CPU) 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system 12 typically includes a variety of computer system readable media. Such media may be any available media that is accessible by computer system 12, and it includes both volatile and non-volatile media, removable and non-removable media.

System memory 28 can include computer system readable media in the form of volatile memory, such as random access memory (RAM) 30 and/or cache memory 32. Computer system 12 may further include other removable/non-removable, volatile/non-volatile computer system storage media. By way of example only, storage system 34 can be provided for reading from and writing to a nonremovable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system 12 may also communicate with one or more external devices 14 such as a keyboard, a pointing device, a display 24, etc.; one or more devices that enable a user to interact with computer system 12; and/or any devices (e.g., network card, modem, etc.) that enable computer system 12 to communicate with one or more other computing devices. Such communication can occur via Input/Output (I/O) interfaces 22. Still yet, computer system 12 can communicate with one or more networks such as a local area network (LAN), a general wide area network (WAN), and/or a public network (e.g., the Internet) via network adapter 20. As depicted, network adapter 20 communicates with the other components of computer system 12 via bus 18. It should be understood that although not shown, other hardware and/or software components could be used in conjunction with computer system 12. Examples, include, but are not limited to: microcode, device drivers, redundant processing units, external disk drive arrays, RAID systems, tape drives, and data archival storage systems, etc.

Figure 2:
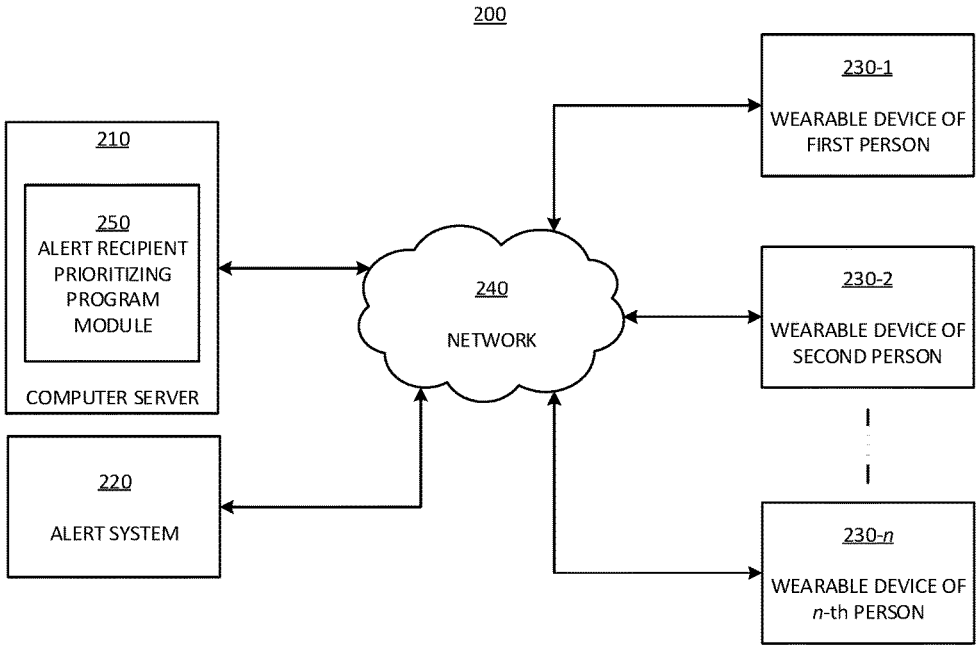
FIG. 2 depicts an illustrative environment in accordance with aspects of the invention.

FIG. 2 depicts an illustrative environment 200 in accordance with aspects of the invention. As shown, the environment 200 comprises a computer server 210 which is in communication with an alert system 220, a wearable device of a first person 230-1, a wearable device of a second person 230-2, and a wearable device of an n-th person **230-*n* via a computer network 240. The computer network 240 may be any suitable network such as a LAN, WAN, or the Internet. The computer server 210 and the alert system 220** may be physically collocated, or may be situated in separate physical locations.

The quantity of devices and/or networks in the environment 200 is not limited to what is shown in FIG. 2. In practice, the environment 200 may include additional devices and/or networks; fewer devices and/or networks; different devices and/or networks; or differently arranged devices and/or networks than illustrated in FIG. 2. Also, in some implementations, one or more of the devices of the environment 200 may perform one or more functions described as being performed by another one or more of the devices of the environment 200.

In embodiments, the computer server 210 may be a computer server 12 as shown in FIG. 1. The computer server 210 may be implemented as hardware and/or software using components such as mainframes; RISC (Reduced Instruction Set Computer) architecture based servers; servers; blade servers; storage devices; networks and networking components; virtual servers; virtual storage; virtual networks, including virtual private networks; virtual applications and operating systems; and virtual clients.

In embodiments, the computer server 210 may include an alert recipient prioritizing program module 250, which may include hardware and/or software and may be one or more of the program modules 42 shown in FIG. 1. According to an embodiment, the alert recipient prioritizing program module 250 includes program instructions for prioritizing alert recipients using activity monitoring data. The program instructions included in the alert recipient prioritizing program module 250 of the computer server 210 may be executed by one or more hardware processors. According to an embodiment, the alert recipient prioritizing program module 250 performs functions related to determining a person to whom an alert is to be sent using activity monitoring data for the person. The alert recipient prioritizing program module 250 may be configured to determine an availability status of a person using activity monitoring data and cause the alert system 220 to send an alert to the person only if the person is determined to be available based on the activity monitoring data. Furthermore, the alert recipient prioritizing program module 250 may be configured to use activity monitoring data for multiple persons to determine the person who is best able to address an alert and cause the alert system 220 to send the alert to that person.

Still referring to FIG. 2, in embodiments, the alert system 220 may be a computer server 12 as shown in FIG. 1. The alert system 220 may be implemented as hardware and/or software using components such as mainframes; RISC (Reduced Instruction Set Computer) architecture based servers; servers; blade servers; storage devices; networks and networking components; virtual servers; virtual storage; virtual networks, including virtual private networks; virtual applications and operating systems; and virtual clients.

In embodiments, the alert system 220 sends alerts to one or more persons. The alerts may be provided as emails, text messages, phone calls, pages, instant messages, or notifications from or within an application. The alerts may also be provided via any other medium and in any other format. The alerts may notify a recipient regarding an issue or a required action or may be used for any other purpose. The alert system 220 may receive information indicating whether or not the recipient received the alert, acknowledged the alert, accepted or rejected the alert, and/or completed an action in response to receiving the alert. The alert system 220 may also receive any additional information from alert recipients. The alert system 220 may be hosted by or provided by a third party. For example, the alert system 220 may be provided as a web service.

Still referring to FIG. 2, in embodiments, each of the wearable device of the first person 230-1, the wearable device of the second person 230-2, and the wearable device of an n-th person **230-*n* may be any type of wearable computer device, activity tracker, fitness tracker, smart watch, sleep tracker, biosensor device, or other device that tracks information related to activity, fitness, location, and/or health. The wearable devices 230-1, 230-2, 230-*n* may collect data that is usable to determine or estimate activities of the wearers. For example, the wearable devices 230-1, 230-2, 230-*n* may be able to determine if a wearer is sleeping, driving, or exercising using data such as movement data and heart rate data. Additionally, the wearable devices 230-1, 230-2, 230-*n*** may collect data that is usable to determine or estimate locations of the wearers.

In embodiments, each of the wearable devices 230-1, 230-2, **230-*n* may transmit collected data (e.g., activity data, location data, and/or fitness data) to the computer server 210 via the network 240 and using a Bluetooth, Wi-Fi, or cellular connection, or via any other networking technology, for use by the alert recipient prioritizing program module 250 as described herein. The wearable devices 230-1, 230-2, 230-*n* may transmit the data in response to a request received from the computer server 210. Alternatively, the wearable devices 230-1, 230-2, 230-*n* may push the aforementioned data to the computer server 210, either at predetermined intervals or in response to a predetermined trigger condition, such as a change in activity status indicated by the activity data or a change in location indicated by the location data. According to an embodiment, a software application may be installed on each of the wearable devices 230-1, 230-2, 230-*n* that is programmed to perform the aforementioned transmission of data in response to a request received from the computer server 210 and/or the aforementioned data push to the computer server 210**.

According to alternative embodiments, each of the wearable devices 230-1, 230-2, **230-*n* may communicate with a mobile device or other computing device associated with the user (e.g., wearer) of the wearable device via a Bluetooth, Wi-Fi, or cellular connection, or via any other networking technology. According to an embodiment, one or more software applications may be installed on the each of the wearable devices 230-1, 230-2, 230-*n* and/or the mobile devices or other computing devices that are programmed to perform the communication between the wearable devices 230-1, 230-2, 230-*n* and the mobile devices or other computing devices. The software application on the mobile devices or other computing devices may request and receive data collected by the wearable devices 230-1, 230-2, 230-*n* (e.g., data related to activity, fitness, location, and/or health). Alternatively, the wearable devices 230-1, 230-2, 230-*n*** may use the software application installed thereon to push the aforementioned data to the mobile devices or other computing devices, and the software application installed on the mobile devices or other computing devices may receive the pushed data.

According to an embodiment, a software application running on the mobile device or other computing device may be programmed to transmit collected data (e.g., activity data, location data, and/or fitness data) to the computer server 210 via the network 240 and using a Bluetooth, Wi-Fi, or cellular connection, or via any other networking technology, for use by the alert recipient prioritizing program module 250 as described herein. This may be the same software application as the one or more software applications installed on the mobile device or other computing device that are programmed to perform the communication between the wearable devices 230-1, 230-2, **230-*n* and the mobile devices or other computing devices. Alternatively, the software application that is programmed to transmit certain collected data to the computer server 210 may be a separate software application from the one or more software applications installed on the mobile device or other computing device that are programmed to perform the communication between the wearable devices 230-1, 230-2, 230-*n* and the mobile devices or other computing devices. The software application may be programmed to transmit the data in response to a request received from the computer server 210. Alternatively, the software application may push the aforementioned data to the computer server 210**, either at predetermined intervals or in response to a predetermined trigger condition, such as a change in activity status indicated by the activity data or a change in location indicated by the location data.

Figure 3:
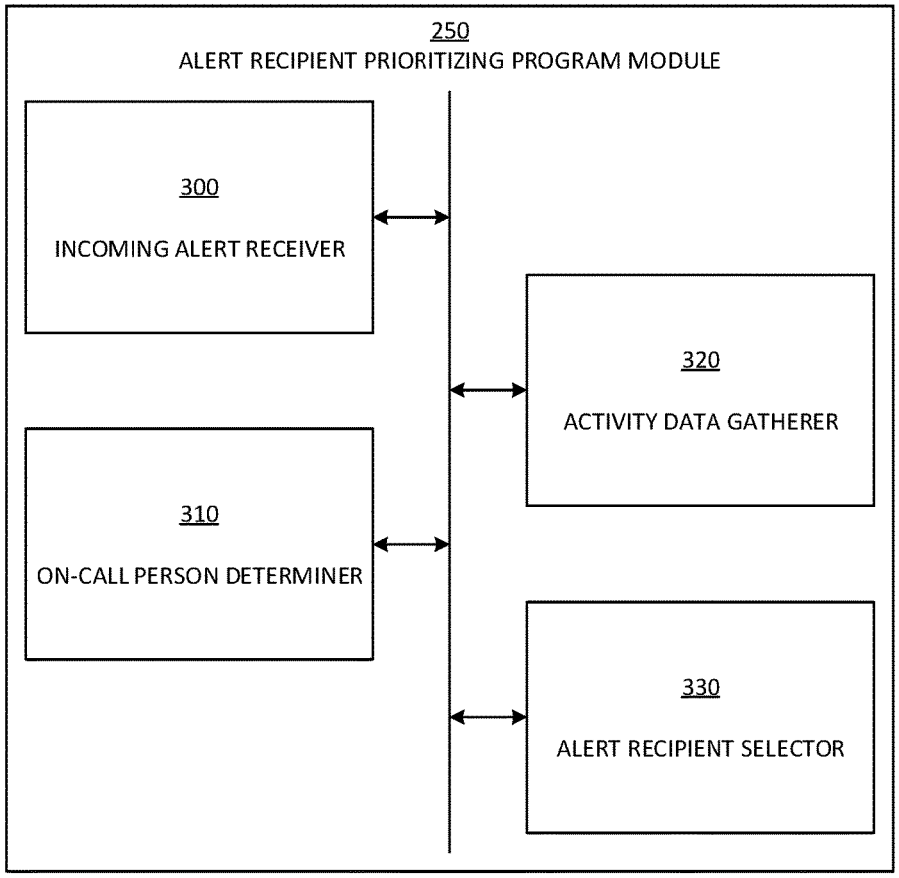
FIG. 3 depicts a block diagram of an exemplary program module in accordance with aspects of the invention.

FIG. 3 depicts a block diagram of an exemplary alert recipient prioritizing program module 250 in the server 210 (of FIG. 2) in accordance with aspects of the invention. In embodiments, the alert recipient prioritizing program module 250 includes an incoming alert receiver 300, an on-call person determiner 310, an activity data gatherer 320, and an alert recipient selector 330, each of which may comprise one or more program modules 42 as described with respect to FIG. 1. In embodiments, the alert recipient prioritizing program module 250 may include additional or fewer components than those shown in FIG. 3. In embodiments, separate components may be integrated into a single computing component or module. Additionally, or alternatively, a single component may be implemented as multiple computing components or modules.

In embodiments, the incoming alert receiver 300 receives a notification from the alert system 220 (of FIG. 2) regarding an alert to be sent to one or more on-call persons. The notification received by the incoming alert receiver 300 may include a name of the alert, a description of the alert, a type of the alert, an on-call group associated with the alert, and any other information regarding the alert.

In embodiments, the on-call person determiner 310 determines a group of persons who are on-call, in response to the incoming alert receiver 300 receiving the notification from the alert system 220 regarding the alert to be sent to the one or more on-call persons. The on-call person determiner 310 may query the alert system 220 to determine the group of persons who are on-call, or the on-call person determine 300 may retrieve information stored by the alert recipient prioritizing program module 250 regarding the group of persons who are on-call. According to an embodiment, the on-call person determiner 310 may use information regarding the on-call group associated with the alert received by the incoming alert receiver 300 to determine the group of persons who are on-call.

In embodiments, the activity data gatherer 320 may gather activity data for one or more persons in the group of persons determined to be on-call by the on-call person determiner 310. The activity data gatherer 320 may select a person from the group of on-call persons determined by the on-call person determiner 310 and gather activity data for the selected person. The activity data gatherer 320 may randomly select the person from the group of on-call persons. Alternatively, the group of on-call persons may be organized in a predetermined order, and the activity data gatherer 320 may sequentially select a next person from the group of on-call persons. In another embodiment, the activity data gatherer 320 may select the person from the group of on-call persons who was least recently sent an alert. According to yet another embodiment, the activity data gatherer 320 may gather (or attempt to gather) activity data for all of the persons in the group of on-call persons.

The activity data gatherer 320 may send a request for activity data, location data, and/or fitness data to a wearable device associated with the selected person (e.g., one of the wearable devices 230-1, 230-2, **230-*n*) and may receive the requested data from the wearable device, as described herein with reference to FIG. 2. Alternatively, the activity data gatherer 320 may send a request for activity data, location data, and/or fitness data to a mobile device or other computing device associated with the selected person that has received activity data, location data, and/or fitness data from a wearable device associated with the selected person (e.g., one of the wearable devices 230-1, 230-2, 230-*n*). According to another embodiment, the activity data gatherer 320 may receive data that is pushed to the computer server 210 by the wearable devices 230-1, 230-2, 230-*n* or mobile devices or other computing devices associated with users of the wearable devices 230-1, 230-2, 230-*n***.

In embodiments, the data associated with the selected person received by the activity data gatherer 320 may be raw activity data, raw location data, and/or raw fitness data collected by sensors on the wearable devices 230-1, 230-2, **230-*n*, and this raw data may be processed by the activity data gatherer 320 to determine or estimate an activity status and/or location status for the selected person. Alternatively, the raw activity data, raw location data, and/or raw fitness data collected by the sensors on the wearable devices 230-1, 230-2, 230-*n* may be processed by hardware and/or software on the wearable devices 230-1, 230-2, 230-*n* or hardware and/or software on mobile devices or other computing devices associated with the wearable devices 230-1, 230-2, 230-*n*, to determine or estimate an activity status and/or location status from the raw activity data, raw location data, and/or raw fitness data, and the determined or estimated activity status and/or location status for the selected person may be received by the activity data gatherer 320**.

While aspects of the present invention may receive raw activity data, raw location data, and/or raw fitness data from user devices including the wearable devices 230-1, 230-2, **230-*n* or track the activity status and/or location status of user devices including the wearable devices 230-1, 230-2, 230-*n***, receiving this data or status may occur on an "opt-in" basis in which a user provides explicit permission for the system to receive the data or status. Further, location tracking may be implemented in accordance with applicable privacy laws and may be discontinued at any time for users who have revoked permission for location tracking.

To the extent the aforementioned implementations collect, store, or employ personal information provided by individuals, it should be understood that such information shall be used in accordance with all applicable laws concerning protection of personal information. Additionally, the collection, storage, and use of such information may be subject to consent of the individual to such activity, for example, through "opt-in" or "opt-out" processes as may be appropriate for the situation and type of information. Storage and use of personal information may be in an appropriately secure manner reflective of the type of information, for example, through various encryption and anonymization techniques for particularly sensitive information.

In embodiments, the alert recipient selector 330 uses the determined or estimated activity status from the activity data gatherer 320 to select an alert recipient from the group of on-call persons determined by the on-call person determiner 310. If the activity data gatherer 320 determines or estimates that the selected person has an activity status that is in a predetermined set of activity statuses that are deemed to be statuses in which a person is available, then the alert recipient selector 330 determines that the selected person is the alert recipient and causes the alert system 220 to send the alert to the alert recipient.

On the other hand, if the activity data gatherer 320 determines or estimates that the selected person has an activity status that is not in the predetermined set of activity statuses that are deemed to be statuses in which a person is available, then the alert recipient selector 330 stores for the selected person a predetermined level of unavailability associated with the activity status and causes the activity data gatherer 320 to select a next person from the group of on-call persons determined by the on-call person determiner 310 and gather activity data for the selected next person. The alert recipient selector 330 then repeats the aforementioned process with the selected next person.

A higher predetermined level of unavailability may indicate a greater degree of unavailability as compared to a lower predetermined level of unavailability. For example, the predetermined level of unavailability associated with an "exercising" activity status and an "eating" activity status may be "1," the predetermined level of unavailability associated with an "attending a performance" activity status may be "2," and the predetermined level of unavailability associated with a "sleeping" activity status may be "3."

If the activity data gatherer 320 gathers (or attempts to gather) activity data for all of the persons in the group of on-call persons as described herein, then the alert recipient selector 330 may determine that all of the persons having an activity status that is in a predetermined set of activity statuses that are deemed to be statuses in which a person is available are the alert recipients. Alternatively, the alert recipient selector 330 may determine that one or more of the persons having an activity status that is in the predetermined set of activity statuses that are deemed to be statuses in which a person is available are the alert recipients, either randomly, using a predetermined order, or based on who was least recently sent an alert.

If the alert recipient selector 330 still has not selected an alert recipient after the process has been repeated for every person in the group of on-call persons determined by the on-call person determiner 310 (e.g., no person in the group of on-call persons has an activity status that is in the predetermined set of activity statuses that are deemed to be statuses in which a person is available), then the alert recipient selector 330 determines that the person having a lowest level of unavailability in the group of on-call persons is the alert recipient. If multiple persons have the lowest level of unavailability in the group of on-call persons, then the alert recipient selector 330 may randomly select a person from the multiple persons that have the lowest level of unavailability as the alert recipient. Alternatively, the group of on-call persons may be organized in a predetermined order, and the alert recipient selector 330 may select one of the persons having the lowest level of unavailability that is first in the predetermined order as the alert recipient. In another embodiment, the alert recipient selector 330 may select the one of the persons having the lowest level of unavailability who was least recently sent an alert as the alert recipient. In yet another embodiment, the alert recipient selector 330 may select all of the persons having the lowest level of unavailability as the alert recipients.

In embodiments, the alert recipient selector 330 may also use the determined or estimated location status from the activity data gatherer 320 to select an alert recipient from the group of on-call persons determined by the on-call person determiner 310. For example, the alert recipient selector 330 may be configured to determine that a person in the group of on-call persons is unavailable if the person is determined or estimated to have a "driving" activity status. However, if the determined or estimated location status indicates that the person will be arriving at a work location within a predetermined period of time, the alert recipient selector 330 may be programmed to deem that the person is available, determine that the person is the alert recipient, and cause the alert system 220 to send the alert to the alert recipient. Alternatively, the alert recipient selector 330 may be programmed to reduce the person's level of unavailability. For example, the alert recipient selector 330 may be programmed to use mapping or GPS data to estimate a person's arrival time at a destination, and if the estimated arrival time is within a predetermined period of time, the person may be deemed to be available.

According to another embodiment, the alert recipient selector 330 may be programmed to estimate when a person will transition from an unavailable status to an available status based upon an amount of that has elapsed since the person entered the unavailable status. For example, the alert recipient selector 330 may be programmed to estimate an expected time when a sleeping person will awaken based upon average sleeping times for the person. The alert recipient selector may reduce a person's level of unavailability or deem a person to be available if the person is expected to enter an available status within a predetermined period of time.

In embodiments, the alert recipient selector 330 may receive information from the alert system 220 regarding a time taken to acknowledge or resolve an alert. The alert recipient selector 330 may use this information to determine average amounts of time required to acknowledge or resolve an alert for each activity status. The alert recipient selector 330 may modify the predetermined unavailability levels associated with each activity status, either for individual on-call persons or for the on-call group as a whole, based on the determined average amounts of time required for each activity status.

Figure 4:
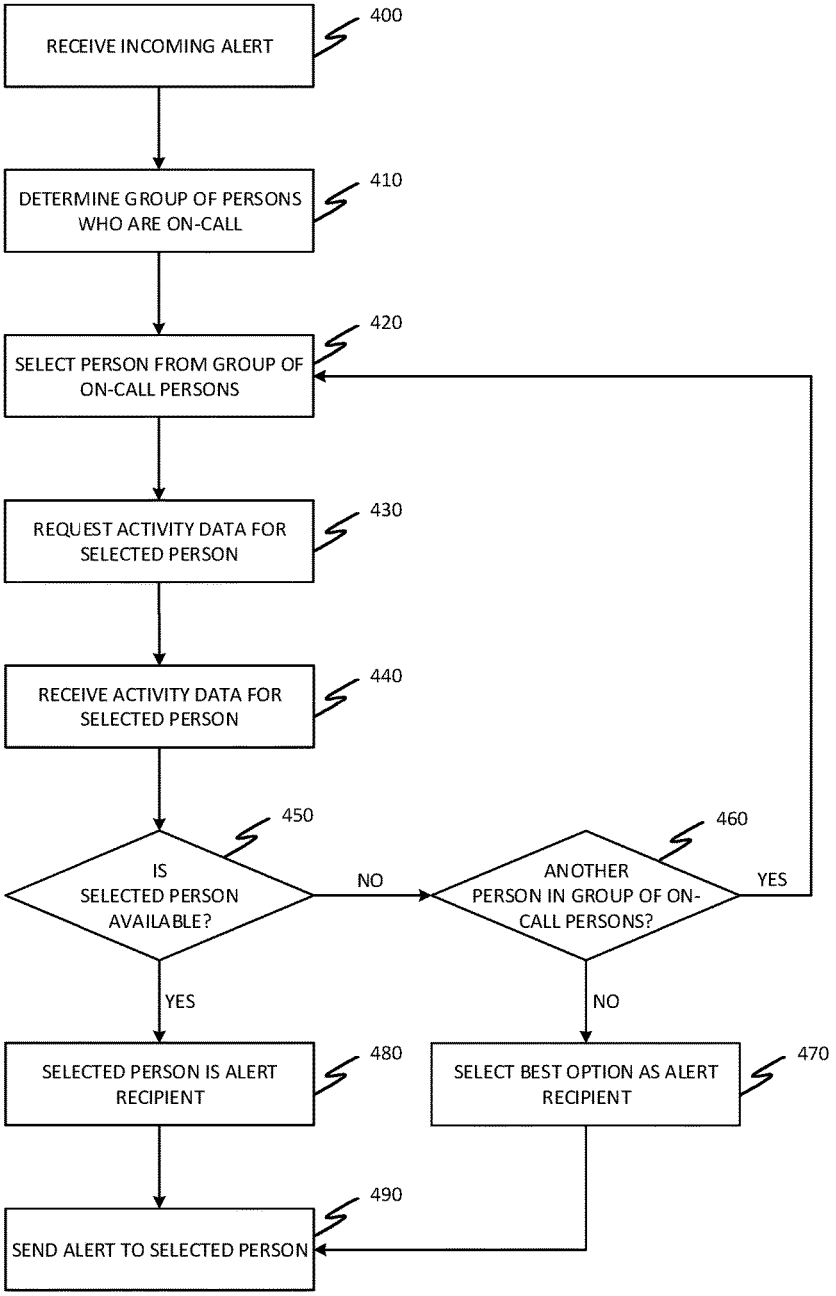
FIG. 4 depicts exemplary methods in accordance with aspects of the invention.

FIG. 4 depicts exemplary methods in accordance with aspects of the invention. The steps of the method may be performed in the environment of FIG. 2 and are described with reference to the elements and steps described with respect to FIGS. 1, 2, and 3.

At step 400, the system receives an incoming alert. In embodiments, as described with respect to FIG. 3, step 400 comprises the incoming alert receiver 300 receiving a notification from the alert system 220 regarding an alert to be sent to one or more on-call persons.

At step 410, the system determines a group of persons who are on-call. In embodiments, as described with respect to FIG. 3, step 410 comprises the on-call person determiner 310 determining a group of persons who are on-call, in response to the incoming alert receiver 300 receiving the notification from the alert system 220 regarding the alert to be sent to the one or more on-call persons.

At step 420, the system selects a person from the group of on-call persons determined at step 410. In embodiments, as described with respect to FIG. 3, step 420 comprises the activity data gatherer 320 selecting a person from the group of on-call persons determined by the on-call person determiner 310.

At step 430, the system requests activity data from the person selected at step 420. In embodiments, as described with respect to FIG. 3, step 430 comprises the activity data gatherer 320 sending a request for activity data, location data, and/or fitness data to a wearable device (e.g., one of the wearable devices 230-1, 230-2, **230-*n*) associated with the person selected at step 420**.

At step 440, the system receives activity data for the selected person, in response to the request at step 430. In embodiments, as described with respect to FIG. 3, step 440 comprises the activity data gatherer 320 receiving activity data, location data, and/or fitness data from the wearable device (e.g., one of the wearable devices 230-1, 230-2, **230-*n*) associated with the person selected at step 420**.

At step 450, the system determines whether or not the selected person is available using the activity data received at step 440. In embodiments, as described with respect to FIG. 3, step 450 comprises the activity data gatherer 320 determining or estimating an activity status using the activity data, location data, and/or fitness data received at step 440 and the alert recipient selector 330 determining whether the determined or estimated activity status is in a predetermined set of activity statuses that are deemed to be statuses in which a person is available. If it is determined in step 450 that selected person is not available, then the flow proceeds to step 460. On the other hand, if it is determined in step 450 that the selected person is available, then the flow proceeds to step 480, and the selected person is determined to be the alert recipient. In embodiments, as described with respect to FIG. 3, step 480 comprises the alert recipient selector 330 determining that the selected person is the alert recipient.

At step 460, the system determines whether or not there is another person in the group of on-call persons determined at step 410. In embodiments, as described with respect to FIG. 3, step 460 comprises the activity data gatherer 320 determining whether or not there is another person in the group of on-call persons determined by the on-call person determiner 310. If it is determined in step 460 that there is another person in the group of on-call persons, then the flow returns to step 420. On the other hand, if it is determined in step 460 that there is not another person in the group of on-call persons, then the flow proceeds to step 470.

At step 470, the system selects a person who is a best option from the group of on-call persons to be the alert recipient. In embodiments, as described with respect to FIG. 3, step 470 comprises the alert recipient selector 330 determining that the person having a lowest level of unavailability in the group of on-call persons determined by the on-call person determiner 310 is the alert recipient.

At step 490, the system sends an alert to the alert recipient selected at step 470 or 480. In embodiments, as described with respect to FIG. 3, step 490 comprises the alert recipient selector 330 causing the alert system 220 to send the alert to the alert recipient.

Figure 5:
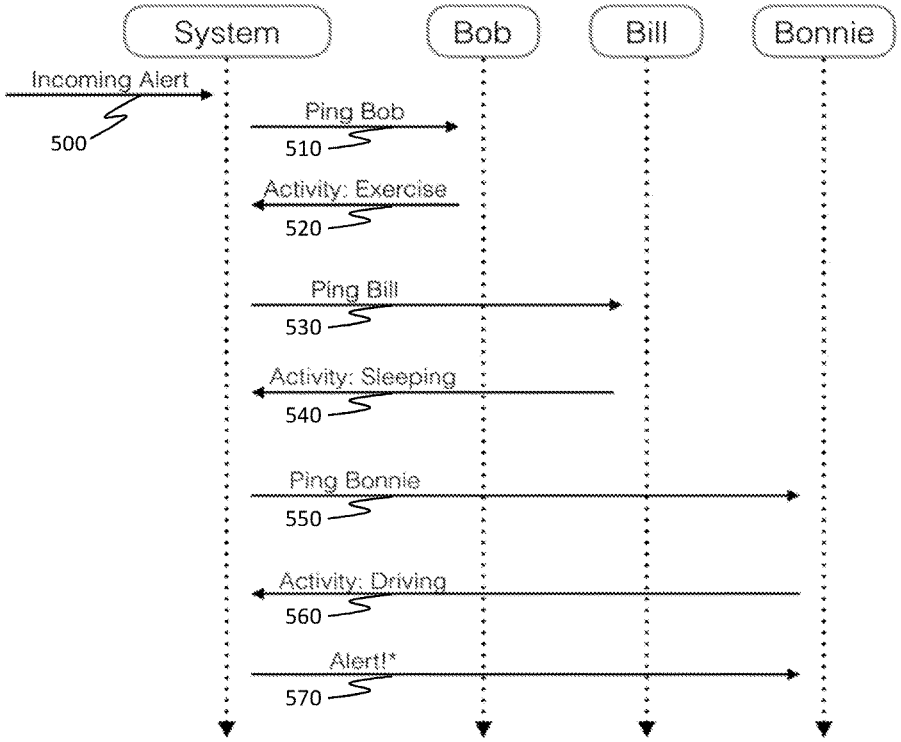
FIG. 5 depicts an example of the system in operation in accordance with aspects of the invention.

FIG. 5 depicts an example of the system in operation in accordance with aspects of the invention. In the example illustrated in FIG. 5, Bob, Bill, and Bonnie are on-call. At step 500, the system receives an incoming alert. At step 510, the system requests an activity status from Bob's wearable device. At step 520, the system receives an "exercise" activity status from Bob's wearable device. Accordingly, Bob is determined to be unavailable. At step 530, the system requests an activity status from Bill's wearable device. At step 540, the system receives a "sleeping" activity status from Bill's wearable device. Accordingly, Bill is determined to be unavailable. At step 550, the system requests an activity status from Bonnie's wearable device. At step 560, the system receives a "driving" activity status as well as a location status from Bonnie's wearable device. While the system would otherwise deem Bonnie unavailable on the basis of her "driving" activity status, based upon Bonnie's location status indicating that she is five minutes from the office, the system deems Bonnie to be available. Accordingly, at step 570, the system sends the alert to Bonnie.

In embodiments, a service provider could offer to perform the processes described herein. In this case, the service provider can create, maintain, deploy, support, etc., the computer infrastructure that performs the process steps of the invention for one or more customers. These customers may be, for example, any business that uses cloud computing technology. In return, the service provider can receive payment from the customer(s) under a subscription and/or fee agreement and/or the service provider can receive payment from the sale of advertising content to one or more third parties.

In still additional embodiments, the invention provides a computer-implemented method, via a network. In this case, a computer infrastructure, such as computer system/server 12 (FIG. 1), can be provided and one or more systems for performing the processes of the invention can be obtained (e.g., created, purchased, used, modified, etc.) and deployed to the computer infrastructure. To this extent, the deployment of a system can comprise one or more of: (1) installing program code on a computing device, such as computer system/server 12 (as shown in FIG. 1), from a computer-readable medium; (2) adding one or more computing devices to the computer infrastructure; and (3) incorporating and/or modifying one or more existing systems of the computer infrastructure to enable the computer infrastructure to perform the processes of the invention.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method comprising:

receiving, by a computing device, an incoming alert;

receiving, by the computing device, activity data corresponding to a first on-call person;

determining, by the computing device, whether or not the first on-call person is available using the activity data corresponding to the first on-call person;

in response to determining that the first on-call person is available, the computing device sending the incoming alert to the first on-call person; and in response to determining that the first on-call person is not available, the computing device sending the incoming alert to a second on-call person in response to:

receiving, by the computing device, activity data corresponding to the second on-call person;

determining, by the computing device, that the second on-call person is not available using the activity data corresponding to the second on-call person; and determining that an unavailability level associated with the second on-call person is lower than an unavailability level associated with the first on-call person, wherein the determining of whether the first on-call person and the second on-call person are available, and the determining of the level of unavailability of the first on-call person and the second on-call person are determined based on data received from biosensor devices and GPS devices of the first on-call person and the second on-call person.

2. The method according to claim 1, wherein the sending the incoming alert to the second on-call person is further in response to the computing device receiving activity data corresponding to the second on-call person and determining that the second on-call person is available using the activity data corresponding to the second on-call person.

3. The method according to claim 1, wherein the computer device communicates with the biosensor devices and the GPS devices of the first on-call person and the second on-call person by at least one selected from the group consisting of: Bluetooth; WiFi; and cellular connection.

4. The method according to claim 1, wherein the activity data corresponding to the first on-call person is received in response to a request from the computing device.

5. The method according to claim 1, wherein activity data received by the computing device is pushed to the computing device at predetermined intervals or in response to a change in activity status.

6. The method according to claim 1, wherein the activity data indicates an activity status selected from the group consisting of sleeping, eating, exercising, and driving.

7. The method of claim 1, further comprising, in response to the first on-call person and the second on-call person having a same unavailability level, randomly selecting one of the first on-call person and the second on-call person for sending the incoming alert to.

8. The method of claim 1, further comprising reducing the level of unavailability of at least one of the first on-call person and the second on-call person based on an estimated arrival time of the first on-call person and the second on-call person, which arrival time is determined based on data received from the respective GPS devices of the first on-call person in the second on-call person.

9. A computer program product comprising a computer readable storage medium having program instructions embodied therewith, the program instructions executable by a computing device to cause the computing device to:

receive a request to transmit an alert;

receive activity data corresponding to each of a plurality of on-call persons;

determine, using the received activity data, each of the plurality of on-call persons is one of available and unavailable; and based on the determining, send the incoming alert to one of:

an only available one of the plurality of on-call persons;

one of a plurality of available ones of the plurality of on-call persons; or a least unavailable one of the plurality of on-call persons, wherein the determining of whether each of the plurality of on-call persons is available, and the determining of the least unavailable one of the plurality of on-call persons, are determined based on data received from biosensor devices and GPS devices of each of the plurality of on-call persons.

10. The computer program product according to claim 9, the program instructions further causing the computing device to, for each of the plurality of on-call persons who is determined to be unavailable, determine a level of unavailability.

11. The computer program product according to claim 9, wherein, for each of the plurality of on-call persons, the activity data corresponding to the on-call person is received from the biosensor device of the on-call person by at least one selected from the group consisting of: Bluetooth; WiFi; and cellular connection.

12. The computer program product according to claim 9, wherein the activity data is received in response to a request from the computing device.

13. The computer program product according to claim 9, wherein activity data received by the computing device is pushed to the computing device at predetermined intervals or in response to a change in activity status.

14. The computer program product according to claim 9, wherein the activity data indicates an activity status selected from the group consisting of sleeping, eating, exercising, and driving.

15. A system comprising:

a hardware processor, a computer readable memory, and a computer readable storage medium associated with a computer device;

program instructions of an incoming alert receiver configured to receive an alert;

program instructions of an on-call person determiner configured to determine a plurality of on-call persons;

program instructions of an activity data gatherer configured to receive activity data corresponding to each of the plurality of on-call persons determined by the on-call person determiner; and program instructions of an alert recipient selector configured to select an alert recipient from the plurality of on-call persons determined by the on-call person determiner using the activity data received by the activity data gatherer and to send the alert received by the incoming alert receiver to the selected alert recipient;

wherein the activity data is data received from biosensor device and GPS devices provided for each of the plurality of on-call persons.

16. The system according to claim 15, wherein the alert recipient selector is configured to select as the alert recipient an on-call person from the plurality of on-call persons who is determined to be available using the activity data received by the activity data gatherer.

17. The system according to claim 15, wherein the alert recipient selector is configured to select as the alert recipient an on-call person from the plurality of on-call persons who is determined to have a lowest unavailability level.

18. The system according to claim 15, wherein the activity data gatherer is configured to receive the activity data in response to a request.

19. The system according to claim 15, wherein the activity data gatherer is configured to receive activity data that is pushed to the system computing device at predetermined intervals or in response to a change in activity status as the activity data.

20. The system according to claim 15, wherein the activity data indicates an activity status selected from the group consisting of sleeping, eating, exercising, and driving.

* * * * *